US005233857A

United States Patent [19]

Magnoni

[11] Patent Number: 5,233,857

[45] Date of Patent: Aug. 10, 1993

[54] CUTTING TOOL FOR DISC-SHAPED METAL SHEETS

[75] Inventor: Franco Magnoni, Modena, Italy

[73] Assignee: S.I.N.T.R.A. S.r.L., Rome, Italy

[21] Appl. No.: 806,018

[22] Filed: Dec. 9, 1991

[30] Foreign Application Priority Data

Dec. 12, 1990 [IT] Italy ..... 40166 A/90

[51] Int. Cl.[5] ..... B21B 27/06

[52] U.S. Cl. ..... 72/71; 29/892.2

[58] Field of Search ..... 72/71; 29/892, 892.1, 29/892.2

[56] References Cited

U.S. PATENT DOCUMENTS

| | | | |
|---|---|---|---|
| 3,225,425 | 12/1965 | Skinner et al. | 72/71 |
| 3,335,597 | 8/1967 | Gobien | 72/71 |
| 3,878,701 | 4/1975 | Skinner | 72/71 |
| 3,893,818 | 7/1975 | Mickus | 72/71 |
| 4,064,724 | 12/1977 | Armstrong | 29/892.2 |

*Primary Examiner*—W. Donald Bray
*Attorney, Agent, or Firm*—Darby & Darby

[57] ABSTRACT

The invention finds application in the field of cutting tools, in particular for the cutting of disc-shaped metal sheets. More precisely, the invention relates to a disk-shaped tool (1) equipped with a knife with a circular cutting edge (4), having laterally two curved flanks (3). The knife (4) inserts itself into the width of a disc-shaped metal sheet (2), partially separating it into two sheets (5).

4 Claims, 1 Drawing Sheet

Fig.4
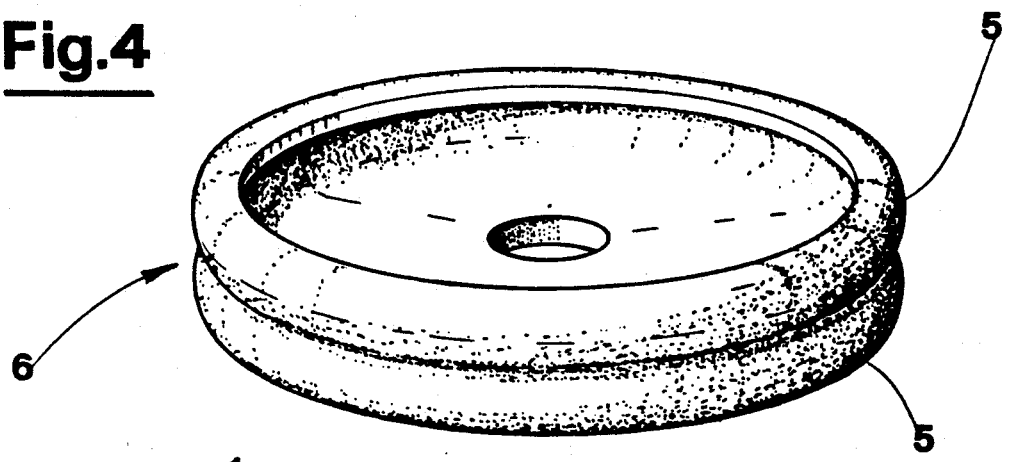
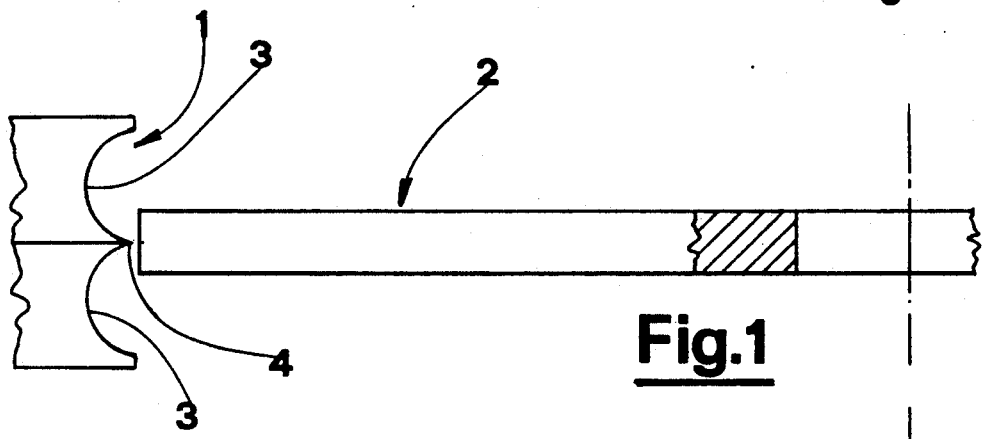
Fig.1
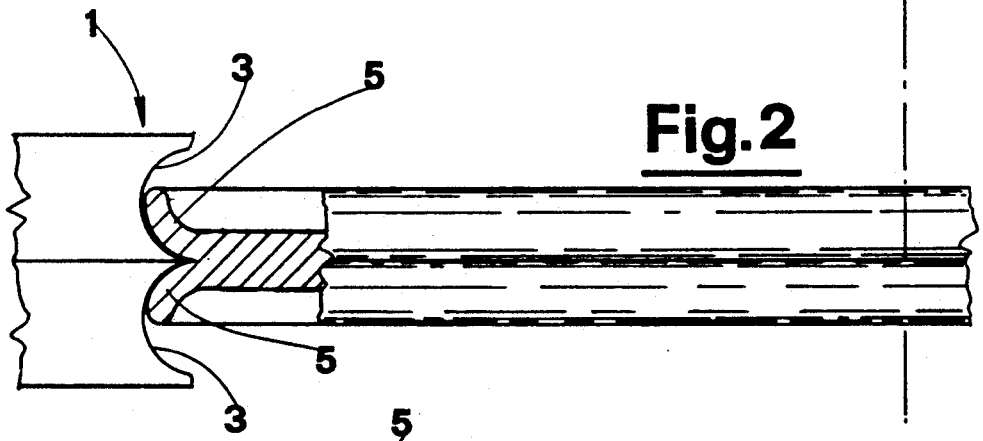
Fig.2
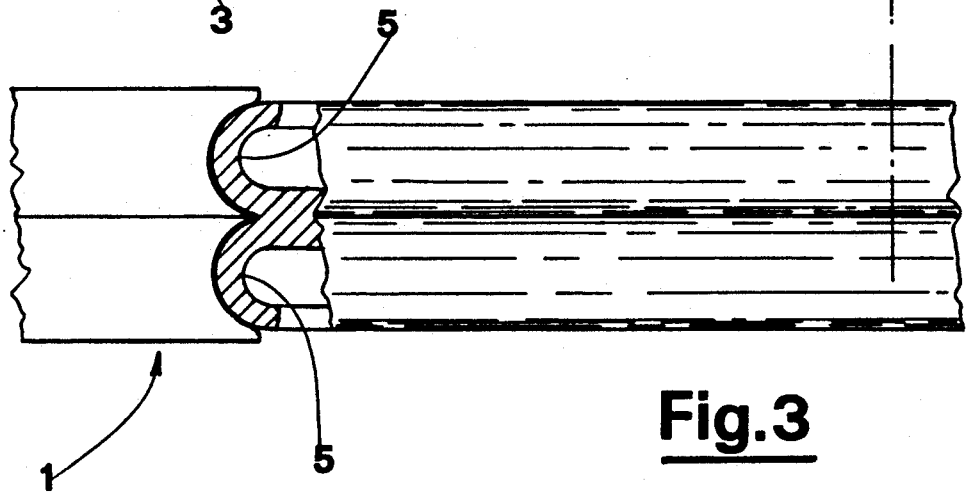
Fig.3

CUTTING TOOL FOR DISC-SHAPED METAL SHEETS

BACKGROUND OF THE INVENTION

The invention relates to a cutting tool for discshaped metal sheets.

By metal sheets, partly-machined flat rolled steel sheets are intended, having the dimension much smaller than the other two; in other words, metal sheets which are thin but thick enough to be further reduced in width by subdivision into further sheets.

The metal sheets specifically referred to are those having disc shape.

The prior art embraces tools which are substantially disc-shaped, which narrow down in the proximity of the external perimeter which perimeter functions as a knife and wedge to penetrate into the width of the sheet in order to obtain a partial separation into two sheets, thus producing a "Y"-shaped conformation in which the "arms" of the letter "Y" represent the two separated sheets, while the "leg" represents the uncut sheet.

Such tools are particularly applied in the making of pulleys, since they can perform on a single metal sheet, thus avoiding the necessity of welding two distinct parts which together constitute the pulley.

With regard to the making of pulleys, the prior art embraces both methods where a welding of two distinct parts is envisaged, and methods where the pulleys are realised from a single block of diskshaped metal by using tools as described above.

Such tools however have several drawbacks. Their maximum penetration depth is limited and rather modes. It has been found that the tool advancement towards depths greater than the thickness of the metal sheet happens with intolerable deviations from the original advancement plan, provoking deformations, undulations and sometimes even complete breaking of the metal sheet.

SUMMARY OF THE INVENTION

An objective of the present invention is to eliminate the above-described drawbacks and in particular to effect a cut into the width of a metal sheet which is without deviations from the advancement plan and which is able to reach greater depths with respect to those prior art tools.

A further objective is to obtain savings in working costs, producing, for example, a pulley, in a shorter time.

Said objectives are fully attained by the cutting tool for disc-shaped metal sheets, object of the present invention, being of the type which is disc-shaped end equipped with a circular perimetral knife to be inserted internally to the width of a sheet to be cut in order to obtain a partial separation or split into two sheets. The knife or central cutting edge has laterally two curved flanks shaped so as to remain in contact with and to deviate, deform and "channel" according to their form, the two metal sheets produced by the cut.

BRIEF DESCRIPTION OF THE DRAWINGS

These and other characteristics will better emerge from the description that follows, of a preferred but not exclusive embodiment of the invention illustrated purely in the form of a non-limiting example in the accompanying FIGS., in which:

FIGS. 1, 2 and 3 schematically and in several successive work phases illustrate the tool and the metal sheet and are partially sectioned according to a plane containing the tool rotation axis;

FIG. 4 illustrates in perspective a partly finished piece of work obtained by use of the tool on a disc-shaped sheet.

DESCRIPTION OF THE PREFERRED EMBODIMENT

With reference to the FIGS. 1 indicates the cutting tool, particularly suitable for diskshaped metal sheets.

The tool 1 is also disc-shaped, equipped with a central knife or central cutting edge 4 arranged around the external perimeter of the disc and equipped laterally with two curved flanks 3.

Said curved flanks 3 extend, in the illustrated embodiment, for an angle between 90° and 180° and can have a arc-shaped section, though not necessarily, inasmuch as their form depends substantially on the type of objects to be created from the metal sheet, or more normally in this case a partly-worked piece, destined to be subjected to further working.

Said curved flanks 3 are preferably identical between themselves and symmetrical with respect to the knife 1.

The essential characteristics of the tool 1 are represented by the conformation of the curved flanks 3 which revolve about the axis of the tool 1 and have a profile, viewable in any axial section, constituted by a tract of curve that has its concavity turned towards the outside of the said tool 1. The tool 1 is particularly suitable for the production of pulleys, wheels or hub-caps of the single-piece type, starting with a single disc-shaped metal sheet 2.

The disc-shaped metal sheet is placed in rotation by known means and is brought into contact with the tool 1, said tool 1 being freely rotatably mobile.

While the metal sheet and the tool revolve, the tool 1 penetrates progressively into the width of the metal sheet 2, splitting it into two sheets 5, which are deviated to run along the curved flanks 3 and constrained to press forcibly against them so that said sheets 5 follow the said curved flanks 3 round and thus assume the particular conformation, as illustrated in FIGS. 2 and 3.

In FIG. 4 a partly-worked piece 6, obtained in the above-described way, is illustrated: from this piece a pulley, a wheel or a hub-cap can be obtained by further working, all from the same single piece.

The conformation of the tool, which, after the cutting zone of the knife 4 has bene passed, forces the two sheets 5 to deviate, deform and follow the curved conformation of the curved flanks 3, guarantees great dynamic stability to the cutting operation and permits of the tool's 1 obtaining correct and centered radial penetrations and thus cuts which are very deep and qualitatively much superior to those attainable with the usual tools.

An advantage provided by the invention is represented by the fact that with a second shaping of the sheets 5 single-sheet discs of various forms and dimensions can be realised.

What is claimed is:

1. A cutting tool for separating the edge of a metal sheet, rotating about a first axis and having first thickness, into two sheets of a lesser second thickness, comprising:

a tool for rotation about a second axis, said tool having a circular cutting edge extending radially from said second axis, and a pair of curved flanks, each of said flanks extending axially and radially from said cutting edge to an outer flank edge to form an annular concavity on each side of said cutting edge, each of said outer flank edges being farther from said second tool axis than the deepest portion of said concavity, said outer flank edges being shaped to turn said two separated sheets back toward the first rotating axis of said disk-shaped sheet during operation of said cutting tool.

2. A cutting tool as in claim 1, wherein the concavity of said flanks has an arcuate cross-section, the angle of arc being between 90° and 180° .

3. A cutting tool as in claim 1 wherein said flanks are symmetrical with respect to said cutting edge.

4. A cutting tool as in claim 1, wherein said tool is free to rotate about said second axis.

* * * * *